US011777199B2

(12) United States Patent
Bani Hani et al.

(10) Patent No.: US 11,777,199 B2
(45) Date of Patent: Oct. 3, 2023

(54) MODULAR WIRELESS MODULES FOR LIGHT FIXTURES

(71) Applicant: ABL IP Holding LLC, Atlanta, GA (US)

(72) Inventors: Mohammad Bani Hani, Glenview, IL (US); Yan Rodriguez, Suwanee, GA (US)

(73) Assignee: ABL IP Holding LLC, Atlanta, GA (US)

( * ) Notice: Subject to any disclaimer, the term of this patent is extended or adjusted under 35 U.S.C. 154(b) by 232 days.

(21) Appl. No.: 17/193,255

(22) Filed: Mar. 5, 2021

(65) Prior Publication Data

US 2022/0285832 A1 Sep. 8, 2022

(51) Int. Cl.

| | |
|---|---|
| ***H01Q 1/22*** | (2006.01) |
| ***H01Q 1/38*** | (2006.01) |
| ***H01Q 5/307*** | (2015.01) |
| ***H01Q 13/10*** | (2006.01) |
| ***H01Q 9/42*** | (2006.01) |

(52) U.S. Cl.

CPC ..... *H01Q 1/38* (2013.01); *H01Q 5/307* (2015.01); *H01Q 9/42* (2013.01); *H01Q 13/10* (2013.01)

(58) Field of Classification Search

CPC ..... H01Q 1/38; H01Q 5/307; H01Q 9/42; H01Q 13/10; H01Q 9/0421; H01Q 21/28; H01Q 1/22; Y02B 20/40; H05B 47/175; H05B 47/19; H05B 47/105

See application file for complete search history.

(56) References Cited

U.S. PATENT DOCUMENTS

| | | | |
|---|---|---|---|
| 4,346,640 | A | 8/1982 | Zeno et al. |
| 5,424,859 | A | 6/1995 | Uehara et al. |
| 6,000,493 | A | 12/1999 | Chen |
| 6,343,135 | B1 | 1/2002 | Ellero et al. |
| 6,528,954 | B1 | 3/2003 | Lys et al. |

(Continued)

FOREIGN PATENT DOCUMENTS

| | | |
|---|---|---|
| CA | 3071829 | 2/2019 |
| CN | 202735830 | 2/2013 |

(Continued)

OTHER PUBLICATIONS

"Gasket", Wikipedia, Available online at: https://en.wikipedia.org/wiki/Gasket, May 1, 2020, 7 pages.

(Continued)

*Primary Examiner* — David E Lotter

(74) *Attorney, Agent, or Firm* — Kilpatrick Townsend & Stockton LLP

(57) ABSTRACT

A light fixture includes a housing containing a light engine, and a wireless baffle module. The wireless baffle module includes a baffle coupled to the housing and used for focusing light emitted from the light engine. The wireless baffle module further includes a wireless printed circuit board assembly coupled to an antenna. The wireless printed circuit board assembly receives and processes wireless signals from the antenna, and sends control signals to the light engine based on the wireless signals. The wireless baffle module may be coupled to a lighting system with an existing non-wireless module, or be used to replace a wireless baffle module with the same or different wireless protocol.

20 Claims, 9 Drawing Sheets

(56) References Cited

U.S. PATENT DOCUMENTS 6,548,967 B1 4/2003 Dowling et al.
6,748,096 B2 6/2004 Chuang
7,162,258 B2 1/2007 Beach et al.
7,446,671 B2 11/2008 Giannopoulos et al.
7,741,782 B2 6/2010 Vermeulen et al.
7,976,048 B2 7/2011 Bartolome Garcia et al.
8,033,686 B2 10/2011 Recker et al.
8,251,544 B2 8/2012 Ivey et al.
8,282,227 B2 10/2012 Massara et al.
8,445,826 B2 5/2013 Verfuerth
8,476,565 B2 7/2013 Verfuerth
8,586,902 B2 11/2013 Verfuerth
8,628,216 B2 1/2014 Ivey et al.
8,675,887 B2 3/2014 Yuan et al.
8,731,689 B2 5/2014 Platner et al.
8,829,821 B2 9/2014 Chobot et al.
8,912,735 B2 12/2014 Chobot et al.
8,981,646 B2 3/2015 Kim
9,053,622 B2 6/2015 Scalisi
9,081,269 B2 7/2015 Conti
9,115,886 B2 8/2015 Lam et al.
9,143,230 B2 9/2015 Casaccia et al.
9,143,741 B1 9/2015 Fu et al.
9,161,111 B2 10/2015 Yuan et al.
9,163,816 B2 10/2015 Baschnagel
9,172,917 B1 10/2015 Fu et al.
9,267,675 B2 2/2016 Wu
9,294,828 B2 3/2016 Rutherford
9,303,863 B2 4/2016 Vaidya
9,313,575 B2 4/2016 Wang et al.
9,320,101 B2 4/2016 Sun et al.
9,328,913 B2 5/2016 Yotsumoto et al.
9,353,939 B2 5/2016 Simon et al.
9,433,061 B2 8/2016 Chobot
9,438,976 B2 9/2016 Wang et al.
9,441,634 B2 9/2016 Spiro
9,532,438 B2 12/2016 Leung et al.
9,554,089 B2 1/2017 Tang et al.
9,561,449 B2 2/2017 Wang et al.
9,568,184 B2 2/2017 Kasuga
9,572,226 B2 2/2017 Motley et al.
9,574,763 B2 2/2017 Chen
9,596,716 B2 3/2017 Deng et al.
9,602,787 B2 3/2017 Blaser, Jr. et al.
9,635,740 B2 4/2017 Sun et al.
9,642,221 B2 5/2017 Schlangen
9,642,222 B2 5/2017 Fathollahi et al.
9,651,243 B1 5/2017 Springer
9,654,678 B1 5/2017 Fu et al.
9,655,216 B2 5/2017 Murakami et al.
9,668,053 B1 5/2017 Rivera et al.
9,713,228 B2 7/2017 Reed
9,717,132 B2 7/2017 Sun et al.
9,726,360 B1 8/2017 Alexander et al.
9,739,472 B1 8/2017 Li
9,746,138 B1 8/2017 Thomas
9,750,118 B2 8/2017 Yotsumoto et al.
9,759,421 B1 9/2017 Baschnagel
9,765,959 B2 9/2017 Yim et al.
9,784,417 B1 10/2017 Springer
9,794,690 B2 10/2017 Wang et al.
9,800,429 B2 10/2017 Crayford et al.
9,805,575 B2 10/2017 Sun et al.
9,807,506 B2 10/2017 Wang et al.
9,820,024 B1 11/2017 Rolf
9,822,963 B2 11/2017 Wang et al.
9,826,298 B2 11/2017 Sun et al.
9,838,652 B2 12/2017 Chien
9,848,265 B2 12/2017 Wen et al.
9,851,092 B2 12/2017 Yotsumoto et al.
9,874,334 B2 1/2018 Chen
9,939,143 B2 4/2018 Spiro
9,955,541 B2 4/2018 Dowling et al.
9,958,149 B2 5/2018 You et al.
10,009,982 B2 6/2018 Ben-Moshe et al.
10,034,356 B2 7/2018 Sun et al.
10,098,211 B2 10/2018 Recker et al.
10,111,296 B2 10/2018 Wu et al.
10,139,099 B2 11/2018 Ivey et al.
2002/0140607 A1 10/2002 Zhou
2004/0175014 A1 9/2004 Liu
2005/0200556 A1 9/2005 Lin et al.
2007/0086724 A1 4/2007 Grady et al.
2007/0222631 A1 9/2007 Haase
2007/0223770 A1 9/2007 Fujisawa et al.
2008/0143495 A1 6/2008 Haase
2009/0136076 A1 5/2009 Chi
2011/0062888 A1 3/2011 Bondy et al.
2011/0121654 A1 5/2011 Recker et al.
2011/0260652 A1 10/2011 Hsieh
2011/0317846 A1 12/2011 Yuan et al.
2012/0206050 A1* 8/2012 Spero ..... B60Q 1/1423 315/152
2012/0218978 A1 8/2012 Ishidoshiro
2012/0320588 A1 12/2012 Quilici et al.
2013/0049633 A1 2/2013 Wann et al.
2013/0308315 A1 11/2013 Capitani et al.
2013/0320861 A1 12/2013 Sinai et al.
2014/0118120 A1 5/2014 Chen et al.
2014/0249234 A1 9/2014 Burns et al.
2014/0270264 A1 9/2014 Wang et al.
2014/0285113 A1 9/2014 Huang
2014/0286011 A1 9/2014 Luna et al.
2014/0286517 A1 9/2014 Luna et al.
2014/0300293 A1 10/2014 Ruan et al.
2014/0328484 A1 11/2014 Molinie et al.
2014/0354160 A1 12/2014 Aggarwal et al.
2015/0043426 A1 2/2015 Aggarwal et al.
2015/0084518 A1 3/2015 Takahashi
2015/0130355 A1 5/2015 Rains, Jr. et al.
2015/0153037 A1 6/2015 Lee
2015/0312394 A1 10/2015 Mirza et al.
2016/0050493 A1 2/2016 Wang et al.
2016/0061438 A1 3/2016 Lu
2016/0072176 A1 3/2016 Van Dijk et al.
2016/0128154 A1 5/2016 Barnetson et al.
2016/0128167 A1 5/2016 Sun et al.
2016/0135271 A1* 5/2016 Alexander ..... H05B 45/20 315/297
2016/0154171 A1 6/2016 Kato et al.
2016/0198542 A1 7/2016 Chiang
2016/0198547 A1 7/2016 Pan et al.
2016/0205362 A1 7/2016 Tang et al.
2016/0205477 A1 7/2016 Kuribayashi et al.
2016/0215933 A1 7/2016 Skelton et al.
2016/0227633 A1 8/2016 Sun et al.
2016/0230982 A1 8/2016 Simon et al.
2016/0234414 A1 8/2016 Chen
2016/0261824 A1 9/2016 Scalisi
2016/0270148 A1 9/2016 Filipovic et al.
2016/0284176 A1 9/2016 Harrington et al.
2016/0295668 A1 10/2016 Saijo
2017/0187154 A1 6/2017 Skelton et al.
2017/0237471 A1 8/2017 Green et al.
2017/0238397 A1 8/2017 Green et al.
2017/0238400 A1 8/2017 Fathollahi et al.
2017/0244148 A1 8/2017 Ge et al.
2017/0295629 A1 10/2017 Chiu et al.
2017/0311062 A1 10/2017 Garrett et al.
2017/0366886 A1 12/2017 Bernier
2018/0050634 A1 2/2018 White et al.
2018/0051872 A1 2/2018 Ivey et al.
2018/0063659 A1 3/2018 Pan
2018/0077779 A1 3/2018 Johnson
2018/0077781 A1 3/2018 McCanless et al.
2018/0132337 A1 5/2018 Honda et al.
2018/0235060 A1 8/2018 Vendetti et al.
2018/0356089 A1 12/2018 Zhang et al.
2019/0014650 A1 1/2019 Schroeder et al.
2019/0027099 A1 1/2019 Kumar et al.
2019/0041050 A1 2/2019 Cairns et al.
2019/0075634 A1* 3/2019 Cho ..... F21V 23/045

(56) References Cited

U.S. PATENT DOCUMENTS

| | | | | |
|---|---|---|---|---|
| 2019/0301727 | A1 | 10/2019 | Sieczkowski | |
| 2019/0394547 | A1 | 12/2019 | Lemons et al. | |
| 2021/0280967 | A1* | 9/2021 | Wu | H01Q 13/10 |

FOREIGN PATENT DOCUMENTS

| | | |
|---|---|---|
| CN | 203193950 | 9/2013 |
| CN | 103809548 | 5/2014 |
| CN | 203605159 | 5/2014 |
| CN | 103899963 | 7/2014 |
| CN | 203801112 | 8/2014 |
| CN | 104020733 | 9/2014 |
| CN | 104378886 | 2/2015 |
| CN | 204231709 | 3/2015 |
| CN | 204442783 | 7/2015 |
| CN | 107250930 | 10/2017 |
| EP | 2506686 | 10/2012 |
| EP | 3036594 | 6/2016 |
| GB | 2544543 | 5/2017 |
| KR | 101641510 | 7/2016 |
| KR | 20160100656 | 8/2016 |
| WO | 2011125845 | 10/2011 |
| WO | 2014084413 | 6/2014 |
| WO | 2014160096 | 10/2014 |
| WO | 2014186040 | 1/2015 |
| WO | 2016052956 | 4/2016 |
| WO | 2016066564 | 5/2016 |
| WO | 2017043671 | 3/2017 |
| WO | 2017062776 | 4/2017 |
| WO | 2017157120 | 9/2017 |
| WO | 2017193781 | 11/2017 |
| WO | 2017215406 | 12/2017 |

OTHER PUBLICATIONS

Sung et al., "Design and Implementation of a Smart LED Lighting System Using a Self Adaptive Weighted Data Fusion Algorithm", Sensors, vol. 13, No. 12, Dec. 6, 2013, 25 pages.

U.S. Appl. No. 16/659,348 , Non-Final Office Action, dated Aug. 20, 2021, 12 pages.

* cited by examiner

MODULAR WIRELESS MODULES FOR LIGHT FIXTURES

FIELD OF INVENTION

Embodiments of the present technology relate to systems for imparting wireless communication capabilities to, and/or improving the wireless communication capabilities of, light fixtures.

BACKGROUND OF THE INVENTION

Connected lighting can include light fixtures and controls that communicate through wireless technologies in order to provide an increased level of control of the light fixture. The connected lighting may be controlled with smartphone applications, web portals, voice-activated devices, other control mechanisms, or any combination thereof. The implementation of connected lighting using one or more wireless communication schemes relies on the addition to a light fixture of one or more antennas capable of receiving and transmitting wireless signals.

In some instances, the arrangement of the antenna on or within a light fixture can detrimentally impact the ability of the antenna to receive and transmit wireless signals. For example, ensuring adequate connectivity of a dual-band antenna for integration of WiFi and Bluetooth capabilities into a light fixture that is installed within a metallic ceiling can be challenging.

SUMMARY OF THE INVENTION

The present technology relates to connected light fixtures including a housing containing a light engine, a baffle, and a wireless module including at least one of a portion of the housing or a baffle coupled to a wireless printed circuit board assembly. For example, the wireless module may include a baffle coupled to a wireless printed circuit board assembly, or the wireless module may comprise an upper compartment of the housing coupled to a wireless printed circuit board assembly. The wireless module may be modularly coupled to the other portions of the light fixture in order to provide wireless connectively to the light fixture. A plurality of different wireless modules with different wireless protocols may be produced to be modularly coupled to a plurality of different light fixture sub-assembly products allowing for a multitude of combinations exceeding the total number of different wireless modules and light fixture sub-assembly products.

This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below.

Figure 1:
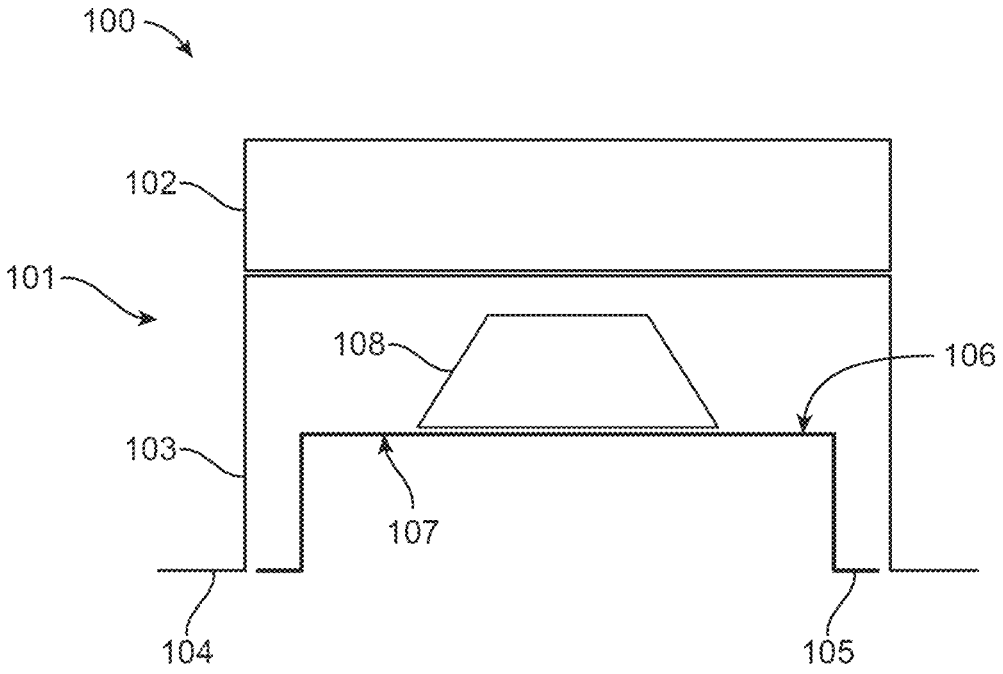
FIG. 1 is a schematic view of structural components of a light fixture, according to embodiments of the technology.

FIG. 1 is a schematic diagram showing structural components of an example of a light fixture 100. As shown, the light fixture 100 may comprise a housing 101. The housing 101 may be of any shape, including, but not limited to, cylindrical (such as for use in a recessed can fixture) or rectangular (such as for use in a linear fixture). In some embodiments, the light fixture 100 is inserted and retained within another structure provided in or on a wall or ceiling. In such embodiments, the housing 101 may include mounting features, for example retaining tabs to couple the housing 101 to a recessed can, swing arms to be retained in a hole in a ceiling for a recessed fixture, and/or rails or holes to a receive a mounting bracket to secure the housing 101 to a structure.

The housing 101 generally houses a light engine which includes light source(s) (e.g., LEDs, not shown), the electronics for powering and controlling the light engine (e.g., driver, circuitry, etc., not shown), and any optical components (reflectors 108, baffles 105, lenses, etc.) for controlling the appearance and/or directionality of the light emitted from the light fixture 100. In some embodiments, these components are provided in different compartments within the housing 101. For example, as shown in FIG. 1A, the housing 101 may comprise an upper compartment 102 and a lower compartment 103. The upper compartment 102 may define an enclosure for housing the electronics of the light fixture 100, for example an LED driver board. The lower compartment 103 may define an interior cavity that houses the light sources and optical components. Light from the light sources is emitted from the lower portion of the lower compartment 103 of the light fixture 100.

The upper compartment 102 and lower compartment 103 of the housing 101 may be formed integrally or as separate components that are coupled together (either permanently or removably). The upper compartment 102 and the lower compartment 103 may be formed of the same material or different materials. The upper compartment 102 and lower compartment 103 may be formed, for example, of plastic or metal. In some embodiments, the upper compartment 102 may be formed of plastic and the lower compartment 103 may be formed of metal or vice versa. In some embodiments, both the upper compartment 102 and the lower compartment 103 may be formed of metal.

Figure 5A:
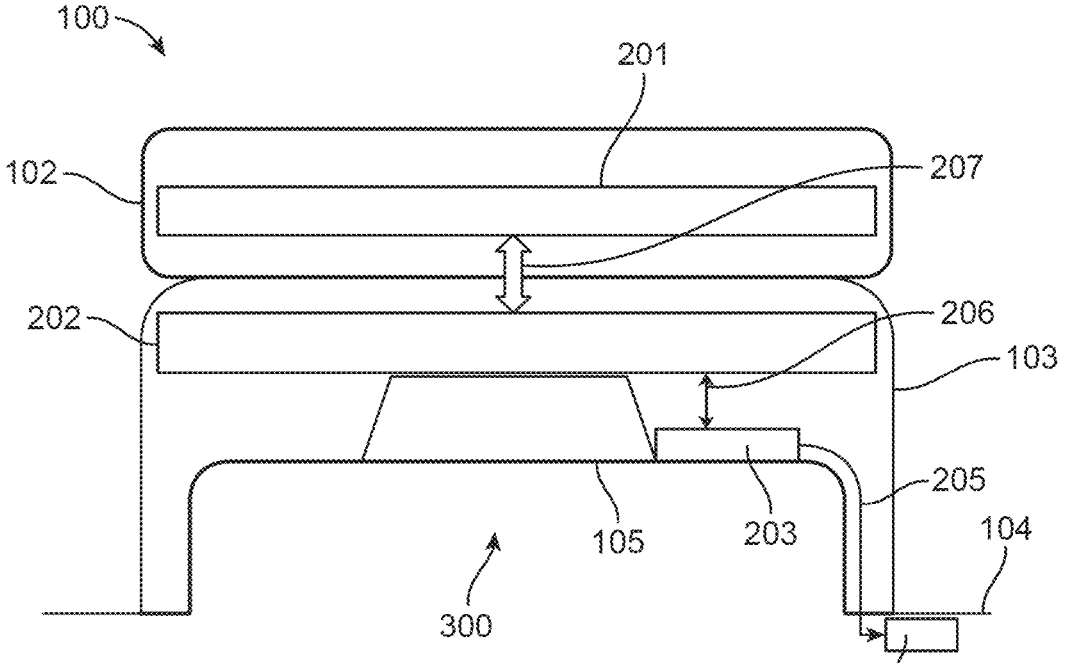
FIGS. 5A and 5B show connected light fixtures including wireless baffle modules, with metal baffles, according to embodiments of the technology.

The housing 101 may be received directly within the structure of a building, for example a ceiling or wall, or may be received within another housing provided on or within a ceiling or wall. Regardless, the housing 101 may include a flange 104 extending radially from a bottom of the housing 101. When the light fixture 100 is installed, for example in a ceiling, the flange 104 contacts the ceiling surface and remains visible to an observer so as impart a polished appearance to the installed light fixture 100. In some embodiments, for example as shown in FIG. 1A, the flange 104 may be integrally formed with the lower compartment 103. In some embodiments, for example as shown in FIG. 5A, the flange 104 may be integrally formed with a baffle 105 provided within the lower compartment 103.

The baffle 105 may be positioned and coupled within the interior cavity of the lower compartment 103 of the housing 101. In some embodiments, the baffle 105 is removably coupled to the lower compartment 103 of the housing 101, for example with clips or threading. The baffle 105 can be any shape that is compatible with the housing 101 and achieves the desired light output from the light fixture 100 (e.g., bowl or truncated cone shaped, square, etc.). The baffle 105 includes an interior surface 106 facing into the interior cavity of the lower compartment 103 of the housing 101, and an outer surface 107 facing away from the housing 101 and toward the area to be illuminated. The outer surface 107 may include a generally concave portion which may be used to focus light emitted from the light fixture 100 through an opening at a top side of the concave portion. Further, the outer surface 107 may also be used for esthetic purposes. The concave portion may be for example in the shape of, but not limited to, a dome, spherical section, truncated cone, or truncated pyramid. The baffle 105 may be shaped and sized to correspond to the interior cavity of the lower compartment 103 of the housing. The baffle 105 may be formed from plastic or metal.

The light fixture 100 may optionally further include a reflector 108 positioned and coupled within the interior cavity of the lower compartment 103 of the housing 101 between the light sources and the baffle 105. The reflector 108 may spread light generated by the light sources, for example a light engine 202 as will be discussed below.

Figure 2:
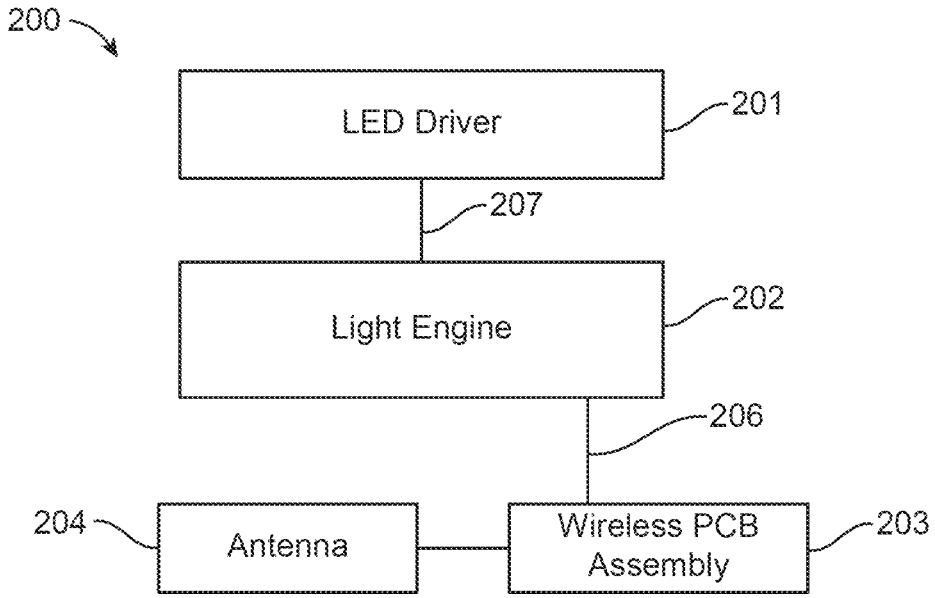
FIG. 2 is a schematic view of electrical/circuitry components of a light fixture, according to embodiments of the technology.

FIG. 2 is a schematic diagram of electronic components 200 that may be provided in light fixture 100. The electronic components 200 may include various circuitry components including an LED driver 201, a light engine 202 (e.g., LEDs), a wireless printed circuit board (PCB) assembly 203, and an antenna 204. As shown, the wireless PCB assembly 203 may be connected to the light engine 202 with a cable 206, and the light engine 202 may be connected to LED driver 201 with cable 207.

The LED driver 201 may receive power from an external power supply and regulate power delivered to the light engine 202 of the light fixture 100. The LED driver 201 may comprise a PCB populated with components for regulating the power, and include an interface for connecting with and controlling the light engine 202. In some embodiments, the LED driver 201 may include an interface for connecting with the wireless PCB assembly 203, as discussed below.

The light engine 202 may comprise a PCB populated with LEDs for generating and emitting light. The light engine 202 may have a first interface for coupling with the LED driver 201 to receive power and control signals. The light engine 202 may have a second interface for coupling to the wireless PCB assembly 203 in order to receive control signals and provide power to the wireless PCB assembly 203 from the LED driver 201. The light engine 202 may be positioned and coupled within the lower compartment 103 of the housing 101 in order to emit light into the reflector 108 to then be focused and emitted by the baffle 105 out of the light fixture 100.

The wireless PCB assembly 203 may comprise a PCB populated with components for processing and converting wireless signals into control signals sent to the light engine 202 and/or the LED driver 201. The wireless PCB assembly 203 may be configured to process signals of one or more different wireless protocols, for example but not limited to: Wireless LAN, ZigBee, Samsung Smart Things, Bluetooth/BLE, and mesh networking. The wireless PCB assembly 203 connects to the light engine 202 and/or LED driver 201 via pogo pins or gold contacts or via a flex cable. The wireless PCB assembly 203 may further comprise an antenna interface in order to couple to the antenna 204. The antenna 204 may be a separate component from the wireless PCB assembly 203. In such embodiments, the antenna 204 may connect to the wireless PCB assembly 203 via a cable 205. In other embodiments, the antenna 204 may be integrated onto the wireless PCB assembly 203 in which case no separate connection method is needed.

Figure 3A:
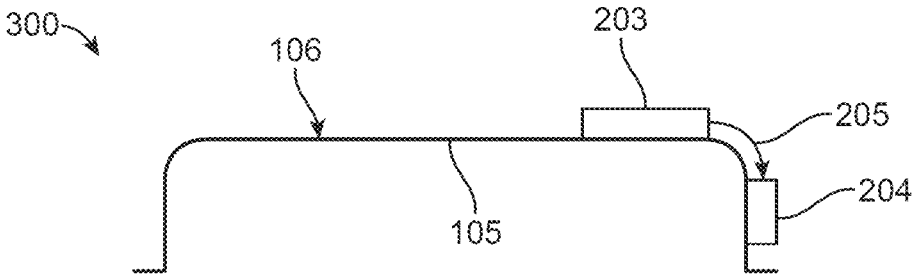
FIGS. 3A and 3B show wireless baffle modules of a light fixture, according to embodiments of the technology.
Figure 3B:
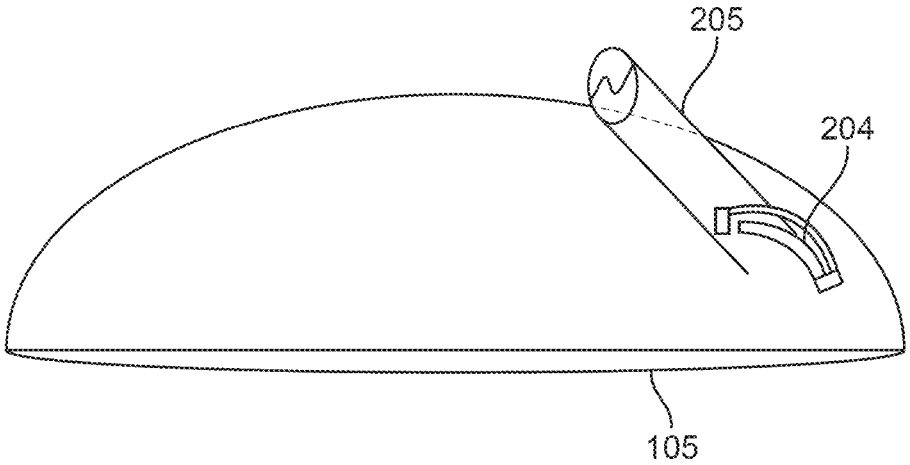

In some embodiments, for example as shown in FIG. 3A, the wireless PCB assembly 203 and antenna 204 are provided on the baffle 105 to form a wireless baffle module 300. As shown in FIG. 3A, the wireless PCB assembly 203 and antenna 204 may be provided on the interior surface 106 of the baffle 105. In some embodiments, the wireless PCB assembly 203 and antenna 204 may be attached to the baffle 105 using adhesives, fasteners, or other attachment means. As noted above, the baffle 105 may be formed of plastic or metal. If the baffle 105 is formed from plastic, the antenna 204 can be made of various topologies that do not require a metal ground plane underneath the antenna 204. Topologies of the antenna 204 disclosed herein may include, but are not limited to printed PCB antennas and printed inverted-F antennas (IFA) on flex substrates, flexible printed circuit board (FPC) antennas, stamped or punched IFA, and dual band slot antennas. While FIG. 3A shows the antenna 204 as a separate component from the baffle 105, the antenna 204 and baffle 105 may alternatively be integrally formed. For example, the antenna 204 may be etched into or stamped from a metal baffle 105 (see FIG. 3B). The type of antenna 204 coupled to the wireless PCB assembly 203 may be based on the frequency band and bandwidth of the wireless protocol of the wireless PCB assembly 203 and/or the material of the structural component the antenna 204 is coupled to or formed integrally with.

Figure 4A:
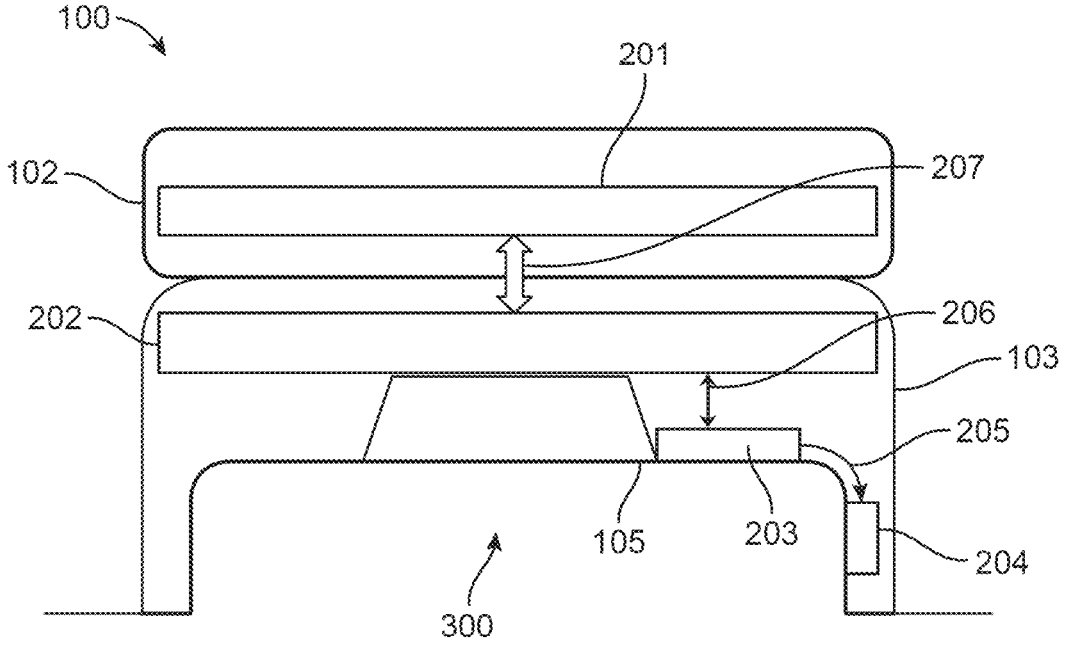
FIGS. 4A and 4B show connected light fixtures including wireless baffle modules, with plastic baffles, according to embodiments of the technology.

A shown in FIG. 4A, when the baffle 105 of the wireless baffle module 300 is positioned within the lower compartment 103 of the housing 101, the wireless PCB assembly 203 and the antenna 204 are located within the interior cavity of the lower compartment 103. The wireless PCB assembly 203 may be connected to the light engine 202 via cable 206 or other connection methods. As shown in FIG. 4A, the antenna 204 may be positioned more proximate to the bottom opening of the lower compartment 103 which may result in a better radio link, as well as positioning the wireless PCB assembly 203 closer to the light engine 202. Further, the antenna 204 is distanced from the other electrical components and other metal components, which improves the radio link and range.

Figure 4B:
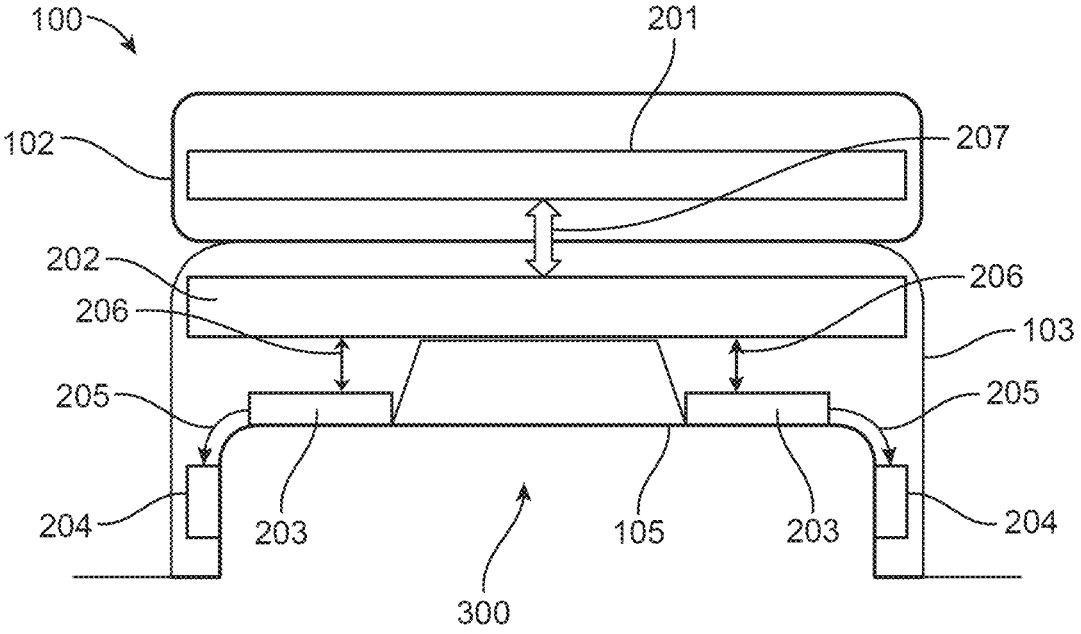

In some embodiments, a wireless baffle module 300 may include multiple pairs of wireless PCB assemblies 203 and antennas 204. For examples, as shown in FIG. 4B, a wireless baffle module 300, similar to the wireless baffle module 300 of FIG. 4A, may include two antennas 204 and two wireless PCB assemblies 203. Each antenna 204 and wireless PCB assembly 203 pairing may be coupled to the interior surface 106 of the baffle 105, and each wireless PCB assembly 203 may be separately coupled to the light engine 202 (such as via cable 206). Each of the different pairs of an antenna 204 and a wireless PCB assembly 203 may be configured for a different wireless protocol, which advantageously allows for the light fixture 100 to be controlled for example by different types of devices, e.g. a home route via wireless LAN and a smartphone via Bluetooth. In some embodiments, two antennas 204 may be coupled to a single wireless PCB assembly 203 configured to receive and process signals for two different wireless protocols from the two antennas 204.

Figure 5B:
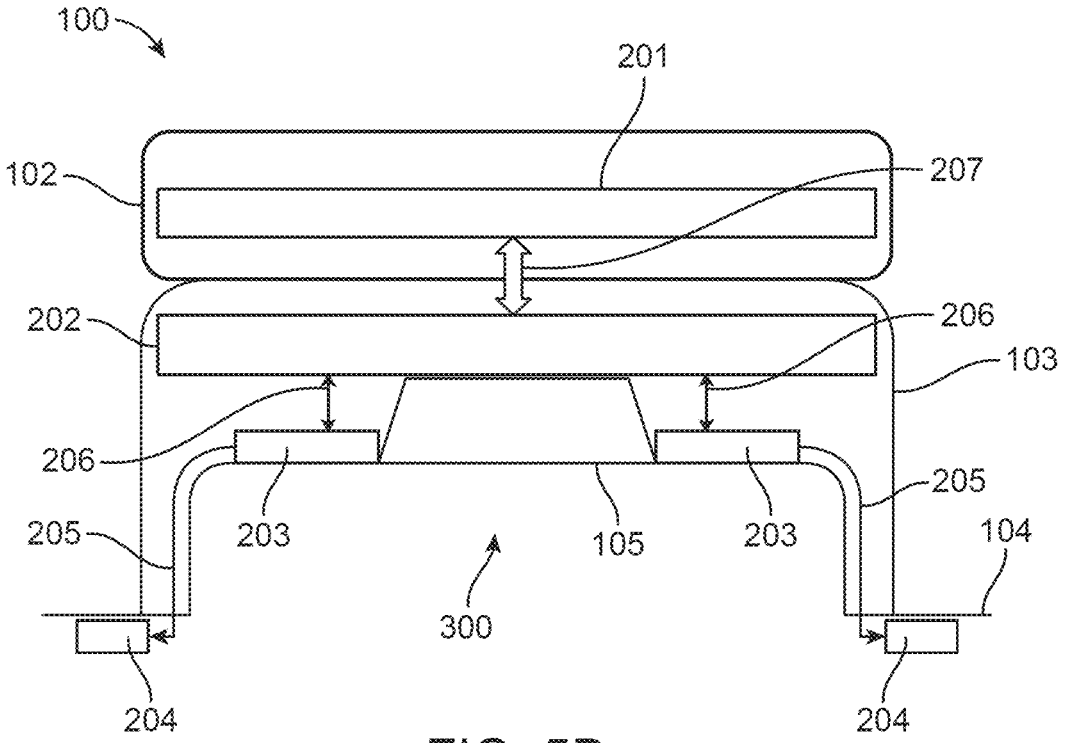
Figure 5C:
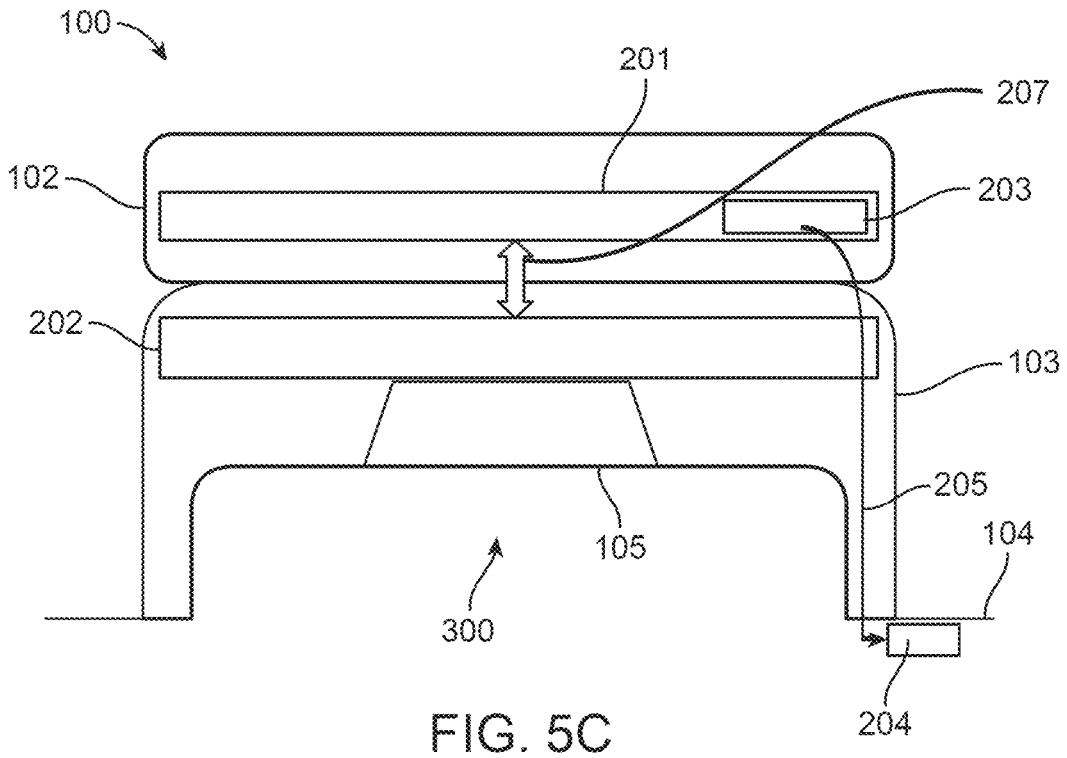
FIGS. 5C and 5D show connected light fixtures including wireless baffle modules, with antenna baffles, according to embodiments of the technology.
Figure 5D:
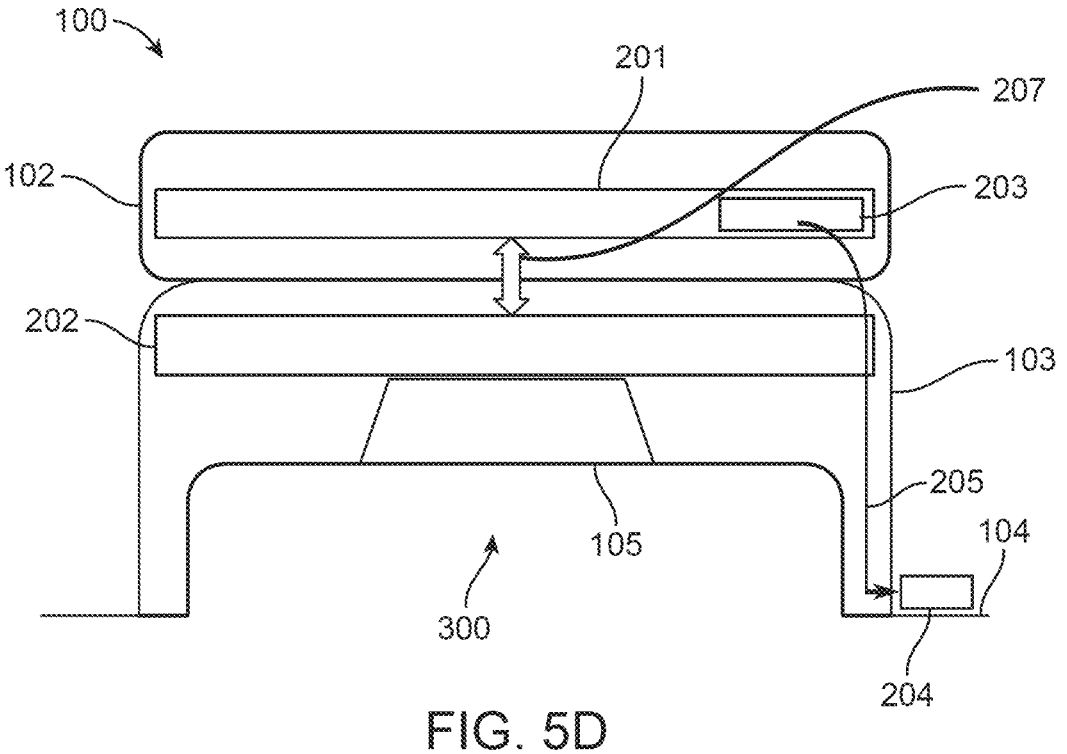

Locating the antenna 204 within the lower compartment 103 may lead to radio link issues, particularly when the lower compartment 103 is made of metal. In some embodiments, the antenna 204 may be positioned outside of the lower compartment 103 of the housing 101. For example, as shown in FIG. 5A, the baffle 105 may be formed integrally with a flange 104, and the antenna 204 may be positioned on the flange 104. As noted above, the baffle 105 may be metal, and in such embodiments the antenna 204 may be integrally formed with the metal flange 104, for example as a stamped IFA as noted above. In some embodiments, for example as shown in FIG. 5B, a wireless baffle module 300, similar to the wireless baffle module of FIG. 5A, may include two antennas 204 and two wireless PCB assemblies 203. Each antenna 204 may be separately integrally formed on the metal flange 104. Each of the different pairs of an antenna 204 and a wireless PCB assembly 203, as shown in FIG. 5B, may be configured for a different wireless protocol. Further for example as shown in FIGS. 5C and 5D, the antenna 204 may be coupled to the baffle 105, either below the baffle 105 as shown in FIG. 5C or above the baffle 105 as shown in FIG. 5C. Additionally, as shown in FIGS. 5C and 5D, the antenna 204 coupled to the baffle 105 may be connected via a cable 205 to a wireless PCB assembly 203 in the upper compartment 102.

The wireless baffle modules 300 discussed above impart the ability to add, change, and/or customize the wireless protocol of a light fixture 100. For example, wireless baffle modules 300 may be used to replace non-wireless baffles in a light fixture 100 so as to impart wireless functionality to the light fixture 100. Furthermore, the wireless baffle modules 300 may be used to replace or add to the wireless capability of a light fixture 100 that already has wireless functionality. For example, a light fixture 100 may include a wireless PCB with wireless LAN protocol, and the baffle of that light fixture may be replaced with a wireless baffle module 300 for example with the zigbee protocol in order to replace the wireless LAN protocol, or add an additional protocol to the light fixture 100.

Further, the wireless baffle modules 300 serve to decouple the wireless communication from the fixtures to allow for easy customization of light fixture wireless protocols by simply mixing and matching the wireless baffle modules 300 and light fixtures 100. More specifically, any of a plurality of different light fixtures may be modularly coupled with any of a plurality of different wireless baffle modules 300 with different wireless protocols in order to allow for a wide range of combinations without requiring a separate product for each combination. For example, a product line may include five different light fixtures that each may support five different wireless protocol configurations. If each combination were to be assembled and sold as a single product, this would require 25 different products, i.e. SKUs. With the present technology, the five different light fixtures and baffle modules can be produced as sub-assembly products and combined together as desired. This results in a total of ten products that can be used to achieve the 25 possible combinations of light fixtures and wireless protocols.

While the wireless PCB assembly 203 and the antenna 204 can be provided on a baffle 105, in other embodiments, the wireless PCB assembly 203 and antenna 204 may be positioned within the upper compartment 102 and connected to the LED driver 201 positioned within the upper compartment 102. In some embodiments, the upper compartment 102, and components provided therein, may form an upper compartment wireless module 600 that can be modularly coupled to the lower compartment 103. As noted above, modularly coupling a module provided with a wireless PCB assembly 203 and antenna 204 to another module containing other components of the light fixture 100 facilitates adding, changing, and/or customizing the wireless protocol of a light fixture 100.

Figure 6A:
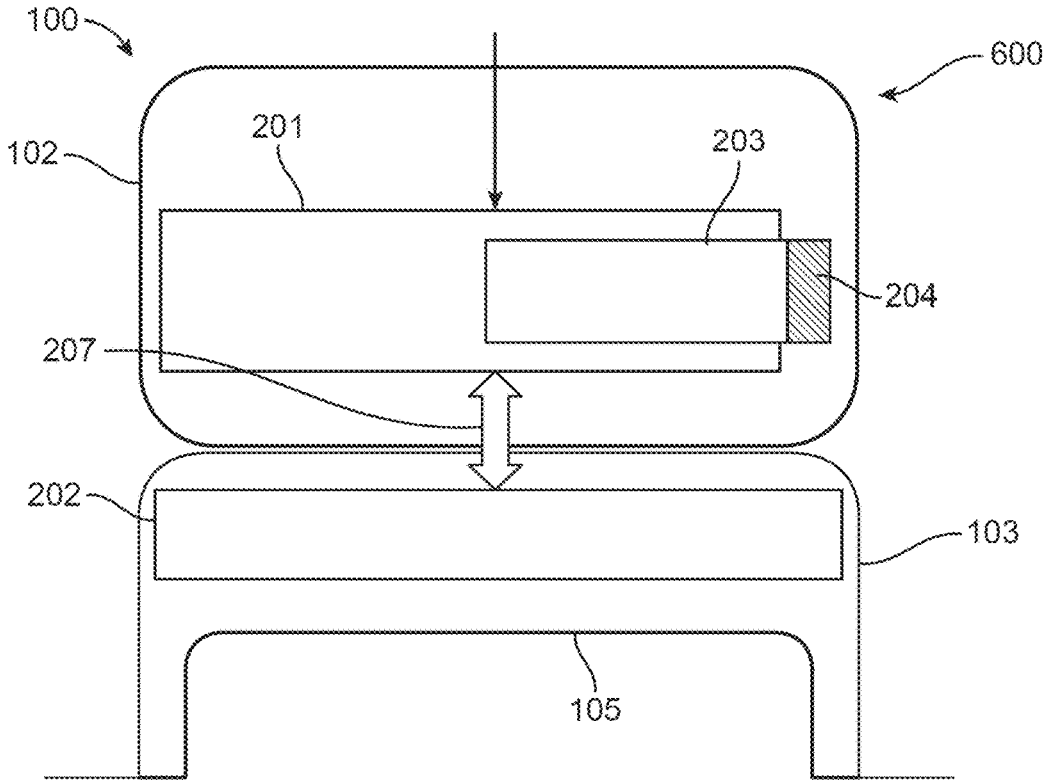
FIGS. 6A and 6B show connected light fixtures including upper compartment wireless modules, according to embodiments of the technology.
Figure 6B:
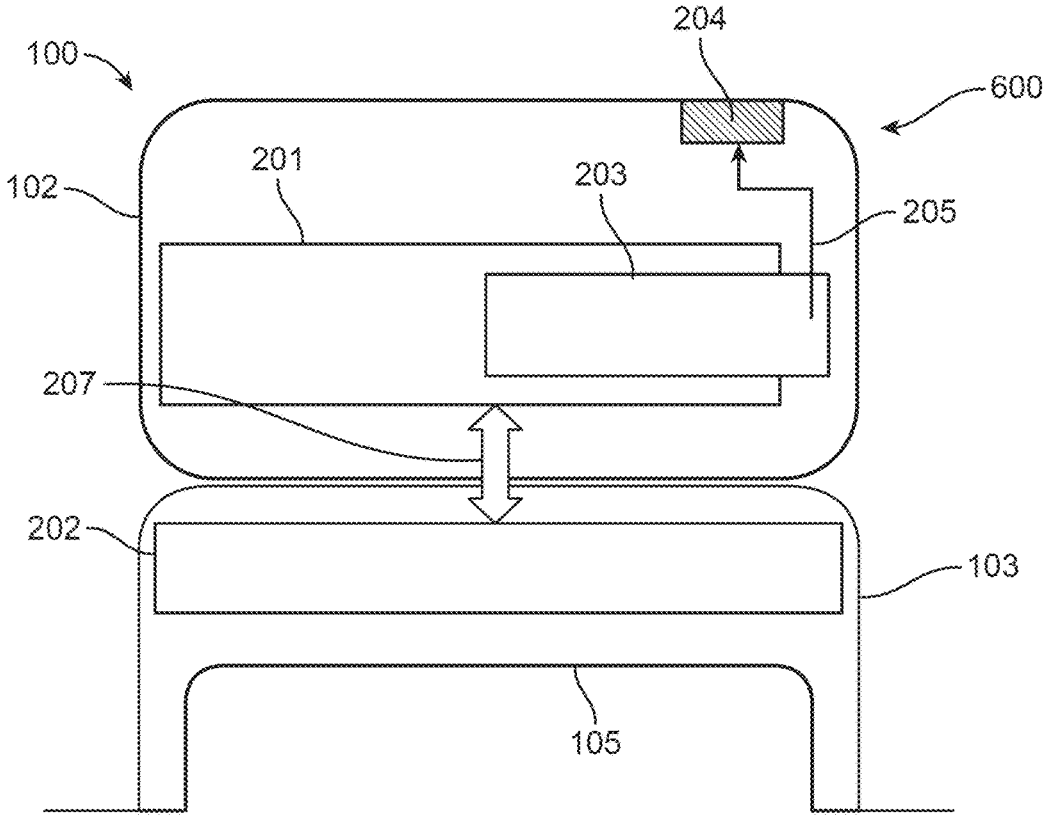

In some embodiments, for example as shown in FIG. 6A, the upper compartment 102 may be formed of plastic, and the wireless PCB assembly 203 may be directly coupled to the LED driver 201, wherein the antenna 204 is a trace antenna on the wireless PCB assembly 203. Due to the plastic upper compartment, a radio link may be established with the antenna 204 through the upper compartment 102. In some embodiments, for example as shown in FIG. 6B, the upper compartment 102 may be comprised of plastic, and the wireless PCB assembly 203 may be directly coupled to the LED driver 201, wherein the antenna 204 is coupled to the interior surface of the plastic upper compartment 102 and coupled to the wireless PCB assembly 203 via coax cable 205. The upper compartment 102 comprised of plastic allows radio signals to transfer from an external source to the antenna 204 housed within the upper compartment 102.

Figure 7:
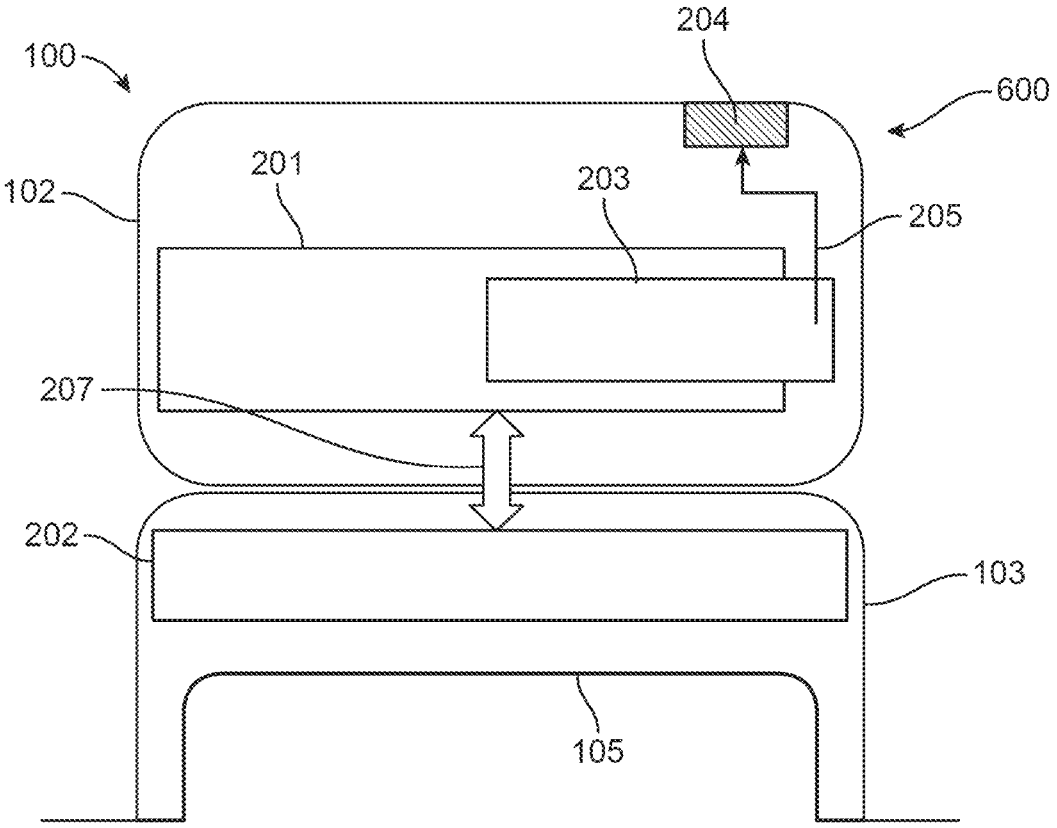
FIG. 7 shows a connected light fixture including an upper compartment wireless module, according to embodiments of the technology.

In some embodiments, for example as shown in FIG. 7, the upper compartment 102 may be formed of metal, which can impede radio signals from reaching an antenna 204 housed within the upper compartment 102. In such embodiments, it may be advantageous to form the antenna 204 integrally with the metal upper compartment 102, for example as a stamped IFA.

Figure 8A:
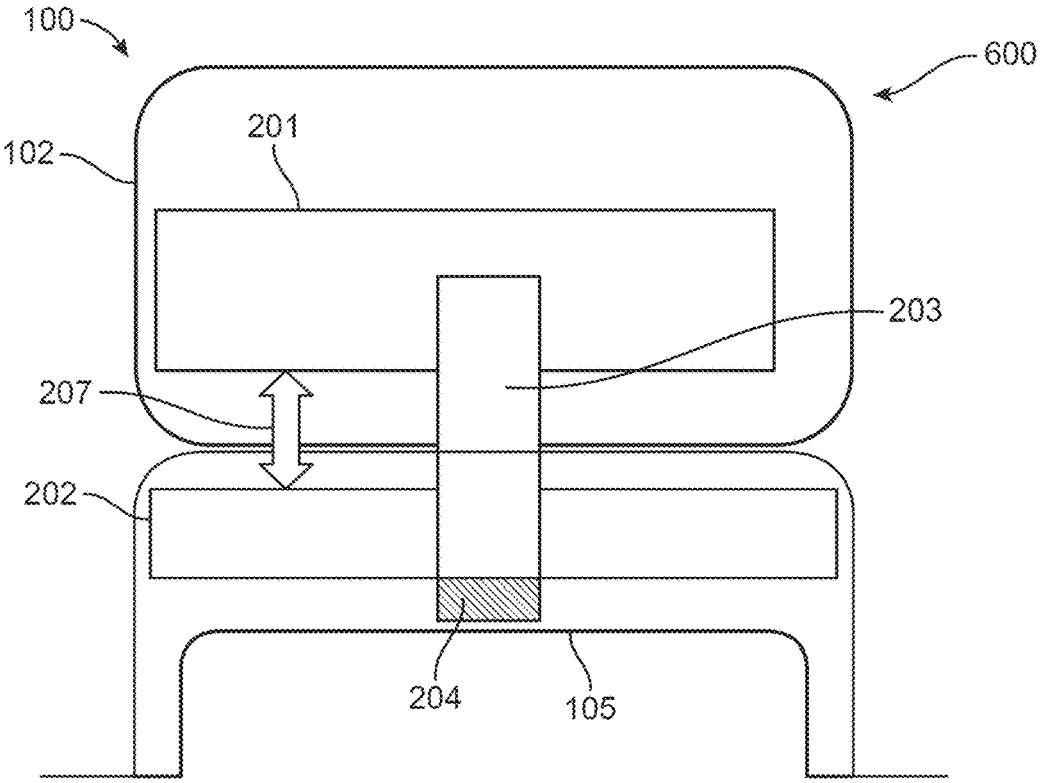
FIGS. 8A-8C show connected light fixtures including upper compartment wireless modules, according to embodiments of the technology.
Figure 8B:
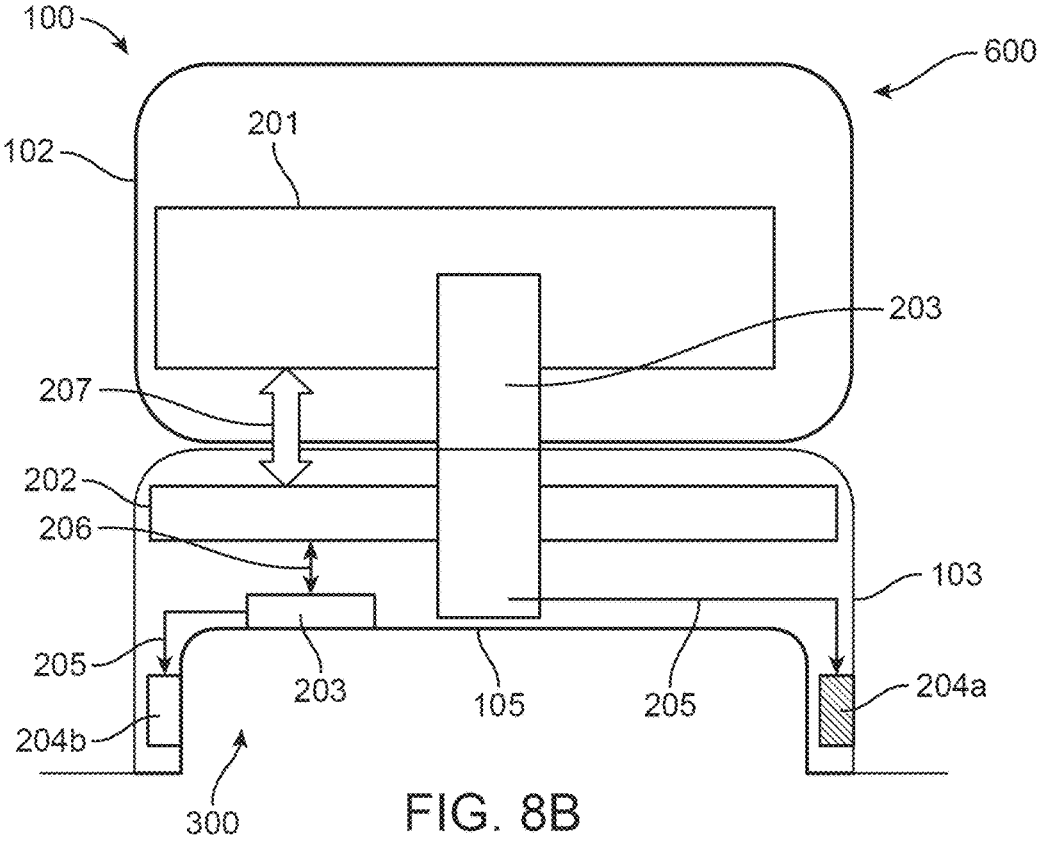

In some embodiments, the wireless PCB assembly 203 may be coupled to an LED driver 201 in the upper compartment 102 in a T-configuration (see FIGS. 8A-8B)

whereby a first end of the wireless PCB assembly 203 is electrically connected to the LED driver 201 and the opposing send end of the wireless PCB assembly 203 is provided with a trace antenna 204. The second end of the wireless PCB assembly 203 extends outside of the upper compartment 102 and into the lower compartment 103 such that the antenna 204 is positioned proximate to the baffle 105, providing an improved radio link and range.

Figure 8C:
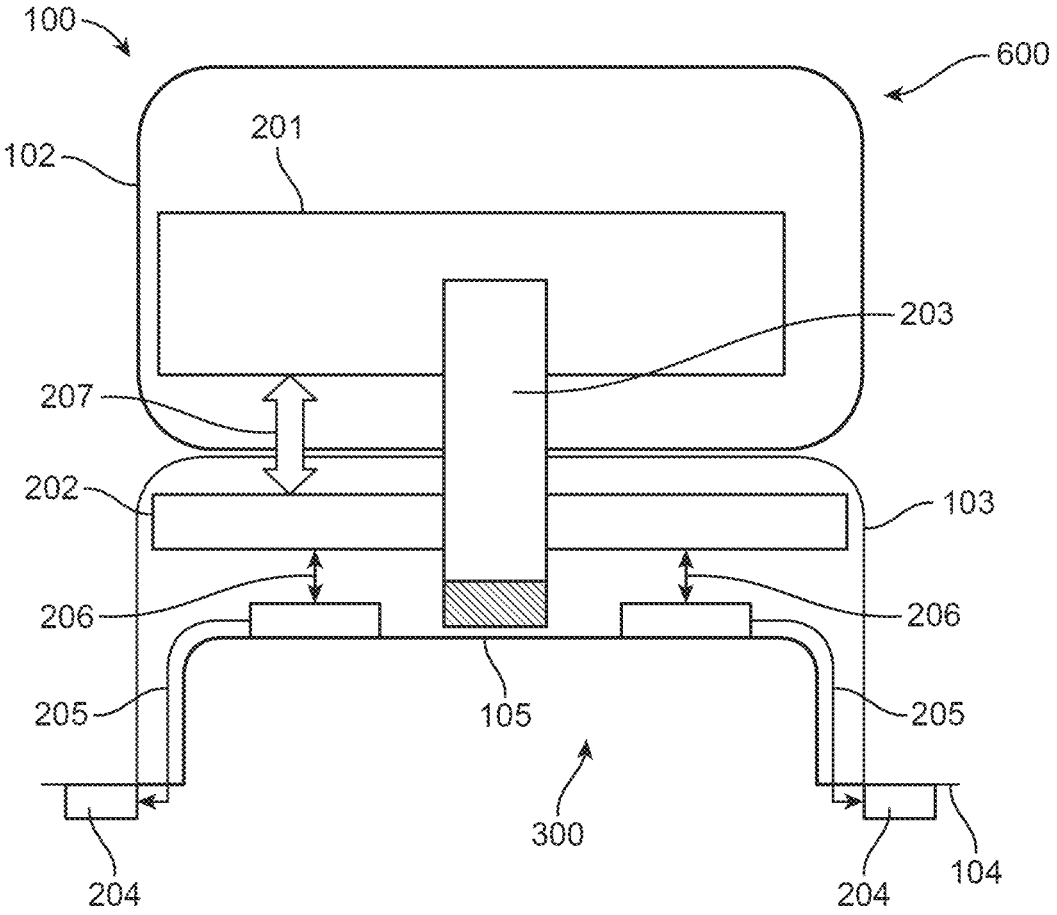

In some embodiments, for example as shown in FIG. 8B, the antenna 204 is de-coupled from the wireless PCB assembly 203 and the portion of the wireless PCB assembly 203 extending into the lower compartment 103 is connected to an antenna 204 that is coupled to or integrally formed on baffle 105 or on the lower compartment 103 itself. By way of example, the antenna 204*a* in FIG. 8B is formed integrally as a stamped IFA within a metal wall of the lower compartment 103. As shown in FIG. 8B, in some embodiments, a light fixture 100 may have antenna 204 coupled to or integrally formed on different portions of the light fixture 100. For example, as shown in FIG. 8B a first antenna 204*a* is integrally formed on the lower compartment 103 and a second antenna 204*b* is coupled to a plastic baffle 105. Providing antennas 204 on different structural components of the light fixture 100 allows different wireless protocols to be associated with different modules allowing for more combinations and customizations. In some embodiments, for example a shown in FIG. 8C, a light fixture 100 may include three different pairs of antennas 204 and wireless PCB assemblies 203. As shown in FIG. 8C, two different pairs of antennas 204 and wireless PCB assemblies 203 are coupled to the baffle 105, and one pair of antenna 204 and wireless PCB assembly 203 is in the T-configuration (as in FIG. 8A).

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A light fixture comprising:

a housing comprising an upper compartment and a lower compartment;

a baffle configured to couple to the housing, wherein the baffle comprises a concave exterior surface configured to focus light generated by the light fixture, and a convex interior surface opposite the concave exterior surface;

a wireless printed circuit board assembly disposed within the upper compartment; and an antenna electrically coupled to the wireless printed circuit board assembly, the antenna coupled to or integrally formed with the baffle, wherein the wireless printed circuit board assembly is configured to be electrically connected to electronics of the light fixture in order to send control signals based on wireless signals received by the antenna.

2. The light fixture of claim 1, wherein the antenna is coupled to the convex interior surface of the baffle and connected to the wireless printed circuit board assembly with coax cable, and wherein the antenna is configured to be positioned within the housing of the light fixture.

3. The light fixture of claim 2, wherein the antenna is one of a printed inverted-F antenna or a flexible printed circuit board antenna, and wherein the antenna is coupled to the baffle with adhesive.

4. The light fixture of claim 1, wherein the antenna is a trace antenna formed on the wireless printed circuit board assembly.

5. The light fixture of claim 1, further comprising:

a second wireless printed circuit board assembly; and a second antenna electrically coupled to the second wireless printed circuit board assembly, wherein the wireless printed circuit board assembly is configured to operate with a first wireless protocol, and the second wireless printed circuit board assembly is configured to operate with a second wireless protocol, different than the first wireless protocol.

6. The light fixture of claim 1, wherein the baffle comprises metal, wherein the antenna is integrally formed on the baffle and connected to the wireless printed circuit board assembly with coax cable, and wherein the coax cable is configured to be positioned within the housing of the light fixture.

7. The light fixture of claim 6, wherein the baffle comprises a flange portion that extends radially outward from the convex interior surface, and wherein the antenna is integrally formed on the flange portion.

8. The light fixture of claim 7, wherein the antenna is one of a stamped or punched IFA, or a dual band slot antenna.

9. The light fixture of claim 6, further comprising:

a second wireless printed circuit board assembly; and a second antenna electrically coupled to the second wireless printed circuit board assembly, wherein the wireless printed circuit board assembly is configured to operate with a first wireless protocol, and the second wireless printed circuit board assembly is configured to operate with a second wireless protocol, different than the first wireless protocol.

10. The light fixture of claim 9, wherein the baffle comprises a flange portion extending radially outward from the convex interior surface, and wherein the antenna and the second antenna are integrally formed on the flange portion.

11. The light fixture of claim 1, further comprising:

a light engine coupled within the housing, and configured to emit the light focused by the baffle, wherein the wireless printed circuit board assembly is electrically coupled to the light engine.

12. The light fixture of claim 1, wherein the housing comprises metal, and wherein the baffle comprises plastic.

13. The light fixture of claim 11, wherein the baffle comprises a flange portion extending radially outward from the convex interior surface, wherein the flange portion comprises metal, wherein the baffle is coupled to the housing with the flange portion extending radially outward from the housing, and wherein the antenna is integrally formed on the flange portion.

14. A method of assembling a light fixture, the method comprising:

providing a housing comprising an upper compartment and a lower compartment, a light engine provided within the housing, a baffle, a wireless printed circuit board assembly, and an antenna coupled to or integrally formed with the baffle;

disposing the wireless printed circuit board assembly within the upper compartment of the housing;

electrically coupling the wireless printed circuit board assembly to the light engine;

coupling the baffle to the housing; and electrically coupling the antenna to the wireless printed circuit board assembly.

15. A light fixture, comprising:

a housing comprising an upper compartment and a lower compartment;

a light engine positioned within the lower compartment, wherein the light engine is configured to emit light;

a wireless printed circuit board assembly disposed within the upper compartment;

an antenna electrically coupled to the wireless printed circuit board assembly, wherein the wireless printed circuit board assembly is configured to be electrically connected to the light engine to send control signals based on wireless signals received by the antenna; and a baffle coupled to the lower compartment, wherein the baffle comprises a concave exterior surface configured to focus the light emitted from the light engine, wherein the antenna is coupled to or integrally formed with the baffle.

16. The light fixture of claim 1, wherein the baffle comprises a flange portion that extends radially outward from the convex interior surface, and wherein the antenna is coupled to or integrally formed on the flange portion.

17. The light fixture of claim 16, wherein the flange portion extends outside the housing and the antenna is located outside the housing.

18. The method of claim 14, wherein the baffle comprises a convex interior surface and a flange portion extending radially outward from the convex interior surface, and wherein providing the antenna coupled to or integrally formed with the baffle comprises providing the antenna on the flange portion of the baffle.

19. The method of claim 18, wherein providing the antenna coupled to or integrally formed with the baffle comprises providing the antenna integrally formed on the flange portion of the baffle.

20. The light fixture of claim 15, wherein the baffle comprises a convex interior surface and a flange portion extending radially outward from the convex interior surface, wherein the baffle is coupled to the lower compartment with the flange portion extending radially outward from the housing, and wherein the antenna is provided on the flange portion.

* * * * *